United States Patent [19]

Silaev et al.

[11] 3,985,513

[45] Oct. 12, 1976

[54] NICKEL-BASE METAL-CERAMIC HEAT-RESISTANT SEALING MATERIAL

[76] Inventors: Alexandr Fedorovich Silaev, ulitsa Krasny Kazanets, 3, korpus 2, kv. 5; Raisa Stepanovna Matjushenko, 5 Kozhukhovskaya ulitsa, 9, kv. 21; Larisa Nikolaevna Popova, Bratskaya ulitsa, 23, korpus 1, kv. 107, all of Moscow; Vasily Alexandrovich Kurganov, ulitsa Simferopolskaya, 5, kv. 30, Kuibyshev; Mikhail Ivanovich Markin, ulitsa Simferopolskaya, 2, kv. 27, Kuibyshev; Viktor Ivanovich Kurakin, ulitsa Sergeya Lazo, 17, kv.28, Kuibyshev; Nina Maximovna Fatjuk, ulitsa Sergeya Lazo, 19, kv. 57, Kuibyshev; Anna Kapitonovna Nazarova, ulitsa Simferopolskaya, 3, kv. 23, Kuibyshev, all of U.S.S.R.

[22] Filed: June 2, 1975

[21] Appl. No.: 583,091

[52] U.S. Cl. ..... 29/182.5; 29/192 R; 75/205; 75/206

[51] Int. Cl.[2] ..... C22C 29/00

[58] Field of Search ..... 29/192 R, 192 CP, 182.5; 75/205, 206; 252/12; 148/24, 26; 106/73.5

[56] References Cited

UNITED STATES PATENTS

| | | | |
|---|---|---|---|
| 2,888,738 | 6/1959 | Taylor | 75/205 X |
| 3,738,817 | 6/1973 | Benjamin | 75/206 X |
| 3,879,831 | 4/1975 | Rigney | 29/182.5 |

OTHER PUBLICATIONS

Fedorchenko, I. M. et al.: "Cermet Materials for Radial Sealing of High Temperature Turbines"–Chem. Abstracts 71 (1969) (15417f) pp. 195–196.

Fustukian, D. et al.: "Composite Powders for Controlled Abradability Applications"–Chem. Abstracts 78 (1973) (6995k) p. 180.

Webster's Int'l Dictionary (1966) p. 625.

Elbert, R. J. –"Porous, Abradable Metallic Materials'-'–Chem. Abstracts 79 (1973) p. 154.

*Primary Examiner*—Helen M. McCarthy
*Attorney, Agent, or Firm*—Haseltine, Lake & Waters

[57] ABSTRACT

A nickel-base metal-ceramic heat-resistant sealing material, comprising, weight per cent:

| | |
|---|---|
| silicon dioxide, | from 0.5 to 8.0 |
| boron nitride, | from 1.0 to 10.0 |
| nickel, | the balance. |

The material has a small hardness number ranging from 25 to 40 kg/mm² and an enhanced heat resistance and thermal stability.

4 Claims, No Drawings

NICKEL-BASE METAL-CERAMIC HEAT-RESISTANT SEALING MATERIAL

The present invention relates to nickel-base metal-ceramic heat-resistant sealing materials produced by the known powder metallurgical methods.

Such materials may prove to be most advantageous when producing sealing members (parts) for such units as, for example, turbine wheel rims exposed to the effect of gas flows at high temperatures.

The nickel-base materials belong to heat-resistant metal-ceramic materials which find use in gas turbine pumps and in certain types of surface transport vehicles and aircrafts.

Known in the art is a nickel-base metal-ceramic heat-resistant material, comprising the following alloying elements, per cent by weight: silicon, up to 3, and graphite, up to 8.

The material is employed for manufacturing plates for radial and labyrinth turbine seals.

However, at a temperature of the gas flow of about 1000° C these materials are not capable of providing long service life of the machines. This is attributable to the burning-out of their graphite component, through which the surface hardness of the sealing members produced from the above material is enhanced with the ensuing higher wear of rotating turbine parts (turbine blades) found in contact therewith.

Moreover, the above-specified material is not suitable for producing sealing members (parts) in the form of rolled band, since graphite increases alloy brittleness.

Some nickel-base materials contain from 5 to 20 per cent by weight of silicon, copper, mica, chromium or boron nitride.

Such materials are capable of providing long service life of machines but at a temperature not in excess of 850° C.

Thus, the nickel-base materials containing copper can operate, as a rule, at a temperature not exceeding 600° C.

Those comprising mica or micaceous compounds (vermiculite, muscovite, etc.) feature lower thermal stability.

The materials comprising chromium (or nichrome-base compounds with the nickel-to-chromium ratio of 4:1) and boron nitride are inapplicable in machines operating at a temperature above 850° C.

As is commonly known, boron nitride is similar in structure to graphite, but in contrast to the latter, it has a higher heat resistance and does not burn out in service.

However, the nickel-base materials containing boron nitride are prone to cubical oxidation by end products of fuel combustion which causes the geometry of sealing places to be disturbed and bands of this material to be distorted during its usage.

At a temperature of gas flows of about 1000° C the known materials do not provide long-term turbine operation. As the turbine blades wear out, the clearance between the turbine rotary shroud rim and its rotating blades, through which hot gases can leak, increases, this resulting in excessive fuel consumption, lower turbine efficiency and in a decrease in the range of operation of a flying vehicle.

Since the speed of transport vehicles is on the rise, turbine ratings increase as well, with the ensuing rise in the temperature of the gas flow in such turbines. Therefore a need has arisen for providing a nickel-base material which would feature a higher heat resistance, improved thermal stability, heat conductivity and minimum wearing of conjugated working parts such as blades.

Moreover, the coefficient of linear expansion of such materials must be equal to or approximate that of the alloy from which the turbine rotary rim is fabricated, and the turbine sealing members must retain their geometry, should not fall out of the shroud rim and should have a hardness allowing conjugated parts to fit in without appreciable wear in their contact places.

The main object of the invention is the provision of a metal-ceramic nickel-base heat-resistant sealing material whose properties would allow using it for manufacturing radial sealing members (parts) operating continuously in gas flows heated to 1000° C.

Another no less important object of the invention is to provide a sealing material which would have a small hardness ranging from 25 to 40 kg/mm$^2$ and a higher heat resistance and thermal stability.

Still another object of the invention is to provide a material suitable for producing insert-pieces for turbine rotary shrouds and allowing turbine blades to fit in without their marked wear.

Said and other objects are achieved by providing a nickel-base metal-ceramic heat-resistant sealing material comprising boron nitride, whose composition, according to the present invention, incorporates, apart from the above-specified components, silicon dioxide, the weight percentage of all the components being:

| | |
|---|---|
| silicon dioxide, | from 0.5 to 8.0 |
| boron nitride, | from 1.0 to 10.0 |
| nickel, | the balance. |

Such material is applicable for producing sealing parts and is capable of providing machine, e.g., gas turbine, operation within 3000 hours at a temperature of a gas flow of up to 1000° C or up to 1100° C within 500 hours.

This is possible because the material comprises the above-specified components taken in appropriate amounts. As shown by research and experiments, the introduction of silicon dioxide into the base of the material for instance into nickel powder makes it possible to enhance the heat resistance of the material owing to an increased resistance of nickel against oxidation.

An addition of boron nitride into nickel powder, introduced in the form of a fine powder, causes a decrease in the hardness of the material owing to separation of nickel grains by boron nitride grains.

The combined introduction of both silicon dioxide and boron nitride in said content makes it possible to obtain an oxide film at the surface of the material at a working temperature of about 1000° C. The film adheres firmly to the material, protecting it against further oxidation and a very important fact is that the thickness of the film does not increase during operation (usage).

When the silicon dioxide content is less than 0.5 weight per cent, the heat resistance of the material decreases and the hardness of the working surfaces of the sealing members produced from this material, increases.

If silicon dioxide is introduced in amounts of more than 8.0 weight per cent, the strength of the oxide film deteriorates, it shows a tendency toward cracking with the film particles being entrained by the gas flow travelling with considerable speeds which may result in a failure of the turbine blades.

With a boron nitride content less than 1.0 weight per cent the hardness of the working surfaces of the sealing members increases which causes excessive wear of conjugated parts in service.

When the amount of boron nitride in the material exceeds 10.0 weight per cent, the heat resistance, thermal stability and mechanical strength of such materials deteriorate.

To make the essence of the present invention more fully apparent given hereinbelow are exemplary compositions of the proposed material.

EXAMPLE 1

The following components are taken (weight per cent) for producing a material:

| | |
|---|---|
| silicon dioxide, | 0.5 |
| hexagonal boron nitride, | 1.0 |
| nickel, | the balance. |

The above-specified components are taken in a powdered state and blended in a drum mixer. On being charged into a steel die, the mixture is compacted in a hydraulic press to impart to it the prescribed shape and required strength.

Next the powder compacts are sintered in electric furnaces in reducing or neutral gases.

The above-outlined procedure is applicable for producing sealing members in the form of plates, rings and bushes. As for the sealing members in the form of a band, these can be obtained by rolling bar stock manufactured by compacting and sintering.

The material, according to the invention, from which the above-described sealing members were produced comprises, weight per cent: silicon dioxide, 0.5; boron nitride, 1.0 and nickel, the balance.

Said parts are secured either mechanically or by soldering them to the rim of a turbine shroud band.

The thus-produced material has the following properties. An increase in weight upon oxidizing in air at a temperature of 1000° C within 100 hours was 0.53 kg/m², surface hardness amounted to 45 kg/mm², density — 7.0 g/cm³ and porosity — 19%.

EXAMPLE 2

A material is produced similarly to that described in the preceding example.

| | |
|---|---|
| silicon dioxide, | 5.0; |
| boron nitride, | 5.0; |
| nickel, | the balance. |

The material has the following properties.

An increase in weight upon oxidizing in air at a temperature of 1000° C within 100 hours amounted to 0.70 kg/m², surface hardness was equal to 48 kg/mm², density 6.5 g/cm³ and porosity 23%.

EXAMPLE 3

A material comprises, weight per cent:

| | |
|---|---|
| silicon dioxide, | 8.0 |
| boron nitride, | 10.0 |
| nickel, | the balance. |

The material was produced in a similar way to that described in Example 1.

The thus-obtained material has the following properties.

An increase in weight upon oxidizing in air at a temperature of 1000° C within 100 hours amounted to 1.1. kg/m², surface hardness was 45 kg/mm², density — 6.3 g/cm³ and porosity — 25%.

As shown by test results, the above-specified material can be advantageously used at elevated temperatures up to 1000° C within several thousand hours; it is also suitable for short-time operation up to 100 hours at a temperature of 1200° C.

The herein-proposed material features a stable chemical composition, e.g., the chemical composition of a sealing member operated within 2000 hours in a gas flow at a temperature of 1000° C did not change and the sealing parts did not exhibit any contraction in spite of continuous vibration.

The sealing material produced according to the present invention had a higher heat resistance. Upon oxidizing in air at a temperature of 1000° C the increase in weight amounted to:

| | |
|---|---|
| during 100 hours | 0.38 kg/m² |
| during 450 hours | 0.64 kg/m² |
| during 1050 hours | 0.91 kg/m² |
| during 1250 hours | 0.95 kg/m² |
| during 1450 hours | 0.95 kg/m² |
| during 1650 hours | 1.04 kg/m² |
| during 1800 hours | 1.05 kg/m² |
| during 2000 hours | 1.06 kg/m² |
| during 3000 hours | 1.10 kg/m². |

The density of the specimens produced from the above material varied from 6.2 to 6.8 g/cm³ and their porosity from 13 to 17%.

Initial Brinell hardness amounted to 20–40 kg/mm². The material features adequate machinability and solderability.

Upon testing for thermal stability in a gas burner flame, no cracks were revealed after 300 cycles with each specimen being heated to 1000° C for 60 s and then cooled to 100° C within 60 s during each cycle.

A band, 1–2 mm thick, of the proposed material has an adequate ductility to be bent into a ring at least 30 mm in dia or to be bent and unbent 30 times in one and the same plane.

Coefficient of linear expansion ($\alpha \cdot 10^6$)

| | |
|---|---|
| (20–100°) | 12.9/1°C |
| (20–700°) | 15.5/1°C |
| (20–800°) | 15.9/1°C |
| (20–900°) | 16.3/1°C |
| (20–1000°) | 16.4/1°C |

Coefficient of heat conductivity (cal/cm s ° C)

| | |
|---|---|
| 25° | 0.088 |
| 100° | 0.084 |
| 500° | 0.078 |
| 700° | 0.078 |
| 1000° | 0.076 |

What we claim is:

1. A nickel-base metal-ceramic heat-resistant sealing material, consisting essentially of in weight per cent:

| | |
|---|---|
| silicon dioxide, | from 0.5 to 8.0 |
| boron nitride, | from 1.0 to 10.0 |
| nickel, | the balance. |

2. The sealing material of claim 1 containing 0.5 per cent silicon dioxide and 1.0 per cent boron nitride.

3. The sealing material of claim 1 containing 5.0 per cent silicon dioxide and 5.0 per cent boron nitride.

4. The sealing material of claim 1 containing 8.0 per cent silicon dioxide and 10.0 per cent boron nitride.

* * * * *